US007528817B2

(12) United States Patent
Osada

(10) Patent No.: US 7,528,817 B2
(45) **Date of Patent: *May 5, 2009**

(54) IMAGE DISPLAY DEVICE AND TESTING METHOD OF THE SAME

(75) Inventor: Takeshi Osada, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/732,178

(22) Filed: Apr. 3, 2007

(65) Prior Publication Data

US 2008/0028268 A1 Jan. 31, 2008

Related U.S. Application Data

(63) Continuation of application No. 10/733,103, filed on Dec. 11, 2003, now Pat. No. 7,205,986.

(30) Foreign Application Priority Data

Dec. 18, 2002 (JP) ..... 2002-366803

(51) Int. Cl.
*G09G 3/36* (2006.01)

(52) U.S. Cl. ..... 345/98; 348/180

(58) Field of Classification Search ..... 345/98–100, 345/204, 87, 76, 92, 94, 208; 315/169.1, 315/169.3; 348/180; 326/9, 11–14, 52, 54
See application file for complete search history.

(56) References Cited

U.S. PATENT DOCUMENTS 4,775,891 A 10/1988 Aoki et al.
5,068,547 A 11/1991 Gascoyne
5,410,247 A 4/1995 Ishizuka
5,825,204 A 10/1998 Hashimoto
6,573,774 B1 6/2003 Gardner
6,651,196 B1 * 11/2003 Iwase et al. ..... 714/724
6,711,041 B2 3/2004 Pereira et al.

(Continued)

FOREIGN PATENT DOCUMENTS

JP 5-256914 10/1993

(Continued)

OTHER PUBLICATIONS

Translation of JP 2000-047255.*

*Primary Examiner*—Amr Awad
*Assistant Examiner*—Stephen G Sherman
(74) *Attorney, Agent, or Firm*—Cook Alex Ltd.

(57) ABSTRACT

It is the primary object of the present invention to provide a simple and accurate testing circuit and a testing method while occupying as small space as possible in an image display device. The testing circuit including a NAND circuit connected in series is mounted on the image display device. A broken wiring on a data signal line and a defect in a data latch circuit can be detected by observing an output waveform from the testing circuit. Accordingly, a broken wiring or the like on the data signal line and a scanning line and a defect in the latch circuit can be tested simply and accurately without an expensive testing apparatus and a great deal of time while occupying as small space as possible.

10 Claims, 6 Drawing Sheets

TESTING CIRCUIT

101 : NAND

U.S. PATENT DOCUMENTS

| | | | |
|---|---|---|---|
| 6,762,617 | B2 | 7/2004 | Iwase et al. |
| 6,762,735 | B2 | 7/2004 | Koyama |
| 6,850,080 | B2 | 2/2005 | Hiroki |
| 2001/0035526 | A1 | 11/2001 | Yamazaki et al. |
| 2001/0040565 | A1 | 11/2001 | Koyama |
| 2002/0130675 | A1 | 9/2002 | Hiroki |
| 2002/0132383 | A1 | 9/2002 | Hiroki et al. |
| 2004/0239598 | A1 | 12/2004 | Koyama |
| 2005/0035805 | A1 | 2/2005 | Tanada |
| 2005/0212044 | A1 | 9/2005 | Hiroki |
| 2006/0156111 | A1 | 7/2006 | Nozawa |

FOREIGN PATENT DOCUMENTS

| | | |
|---|---|---|
| JP | 2618042 | 6/1997 |
| JP | 2000-47255 | 2/2000 |
| JP | 2002-14337 | 1/2002 |
| JP | 2002-32035 | 1/2002 |
| JP | 2002-116423 | 4/2002 |
| JP | 2002-350513 | 12/2002 |
| JP | 2003-31814 | 1/2003 |
| WO | WO 2004/086070 A1 | 10/2004 |

* cited by examiner

TESTING CIRCUIT

101 : NAND

[ n = odd ]

| | $V_1$ | $V_2$ | $V_3$ | $V_4$ | $V_5$ | $V_6$ | ····· | $V_n$ | |
|---|---|---|---|---|---|---|---|---|---|
| $NAND_{OUT}$ | $O_1$ | $O_2$ | $O_3$ | $O_4$ | $O_5$ | $O_6$ | ····· | $O_n$ | |
| $V_{Data}$ | 1 | 1 | 1 | 1 | 1 | 1 | ····· | 1 | 401 |
| $NAND_{OUT}$ | 0 | 1 | 0 | 1 | 0 | 1 | ····· | 0 | |
| $V_{Data}$ | 1 | 1 | 1 | 0 | 1 | 1 | ····· | 1 | 402 |
| $NAND_{OUT}$ | 0 | 1 | 0 | 1 | 0 | 1 | ····· | 0 | |
| $V_{Data}$ | 0 | 1 | 1 | 0 | 1 | 1 | ····· | 1 | 403 |
| $NAND_{OUT}$ | 1 | 0 | 1 | 1 | 0 | 1 | ····· | 0 | |
| $V_{Data}$ | 0 | 0 | 1 | 0 | 1 | 1 | ····· | 1 | 404 |
| $NAND_{OUT}$ | 1 | 1 | 0 | 1 | 0 | 1 | ····· | 0 | |
| $V_{Data}$ | 0 | 0 | 0 | 1 | 1 | 1 | ····· | 1 | 405 |
| $NAND_{OUT}$ | 1 | 1 | 1 | 0 | 1 | 0 | ····· | 1 | |
| $V_{Data}$ | 0 | 0 | 0 | 1 | 0 | 1 | ····· | 1 | 406 |
| $NAND_{OUT}$ | 1 | 1 | 1 | 0 | 1 | 0 | ····· | 1 | |
| $V_{Data}$ | 0 | 0 | 0 | 1 | 0 | 0 | ····· | 1 | 407 |
| $NAND_{OUT}$ | 1 | 1 | 1 | 0 | 1 | 1 | ····· | 0 | |

FIG.5A

[ n = odd ]

| | $V_1$ | $V_2$ | $V_3$ | $V_4$ | $V_5$ | $V_6$ | ····· | $V_n$ | |
|---|---|---|---|---|---|---|---|---|---|
| $NAND_{OUT}$ | $O_1$ | $O_2$ | $O_3$ | $O_4$ | $O_5$ | $O_6$ | ····· | $O_n$ | |
| $V_{Data}$ | 1 | 1 | 1 | 0 | 1 | 1 | ····· | 1 | 501 |
| $NAND_{OUT}$ | 0 | 1 | 0 | 1 | 0 | 1 | ····· | 0 | |
| $V_{Data}$ | 0 | 1 | 1 | 0 | 1 | 1 | ····· | 1 | 502 |
| $NAND_{OUT}$ | 1 | 0 | 1 | 1 | 0 | 1 | ····· | 0 | |
| $V_{Data}$ | 0 | 0 | 1 | 0 | 1 | 1 | ····· | 1 | 503 |
| $NAND_{OUT}$ | 1 | 1 | 0 | 1 | 0 | 1 | ····· | 0 | |
| $V_{Data}$ | 0 | 0 | 0 | 0 | 1 | 1 | ····· | 1 | 504 |
| $NAND_{OUT}$ | 1 | 1 | 1 | 1 | 0 | 1 | ····· | 0 | |
| $V_{Data}$ | 0 | 0 | 0 | 0 | 1 | 1 | ····· | 1 | 505 |
| $NAND_{OUT}$ | 1 | 1 | 1 | 1 | 0 | 1 | ····· | 0 | |
| $V_{Data}$ | 0 | 0 | 0 | 0 | 0 | 1 | ····· | 1 | 506 |
| $NAND_{OUT}$ | 1 | 1 | 1 | 1 | 1 | 0 | ····· | 1 | |

FIG.5B

[ n = odd ]

| | $V_1$ | $V_2$ | $V_3$ | $V_4$ | $V_5$ | $V_6$ | ····· | $V_n$ | |
|---|---|---|---|---|---|---|---|---|---|
| $NAND_{OUT}$ | $O_1$ | $O_2$ | $O_3$ | $O_4$ | $O_5$ | $O_6$ | ····· | $O_n$ | |
| $V_{Data}$ | 1 | 1 | 1 | 1 | 1 | 1 | ····· | 1 | 507 |
| $NAND_{OUT}$ | 0 | 1 | 0 | 1 | 0 | 1 | ····· | 0 | |
| $V_{Data}$ | 0 | 1 | 1 | 1 | 1 | 1 | ····· | 1 | 508 |
| $NAND_{OUT}$ | 1 | 0 | 1 | 0 | 1 | 0 | ····· | 1 | |
| $V_{Data}$ | 0 | 0 | 1 | 1 | 1 | 1 | ····· | 1 | 509 |
| $NAND_{OUT}$ | 1 | 1 | 0 | 1 | 0 | 1 | ····· | 0 | |
| $V_{Data}$ | 0 | 0 | 0 | 1 | 1 | 1 | ····· | 1 | 510 |
| $NAND_{OUT}$ | 1 | 1 | 1 | 0 | 1 | 0 | ····· | 1 | |
| $V_{Data}$ | 0 | 0 | 0 | 1 | 1 | 1 | ····· | 1 | 511 |
| $NAND_{OUT}$ | 1 | 1 | 1 | 0 | 1 | 0 | ····· | 1 | |
| $V_{Data}$ | 0 | 0 | 0 | 1 | 0 | 1 | ····· | 1 | 512 |
| $NAND_{OUT}$ | 1 | 1 | 1 | 0 | 1 | 0 | ····· | 1 | |
| $V_{Data}$ | 0 | 0 | 0 | 1 | 0 | 0 | ····· | 1 | 513 |
| $NAND_{OUT}$ | 1 | 1 | 1 | 0 | 1 | 1 | ····· | 0 | |

IMAGE DISPLAY DEVICE AND TESTING METHOD OF THE SAME

This application is a continuation of U.S. application Ser. No. 10/733,103, filed on Dec. 11, 2003 now U.S. Pat. No. 7,205,986.

BACKGROUND OF THE INVENTION

Field of the Invention

The present invention relates to an image display device in which a plurality of pixels are arranged in matrix and a testing method of the image display device.

In recent years, image display devices such as a liquid crystal display (LCD) and an electro luminescence (EL) display have been advanced in high-resolution and the degree of integration of elements has been remarkably improved as well.

It is an essential part of the production line of image display device to test if a circuit implemented on a substrate operates normally before shipment of a finished panel. The test process itself has been becoming more complicated in accordance with the high-resolution of the image display device.

FIG. 2 shows a configuration diagram of an image display device on which a test circuit using a conventional art is implemented. On a substrate 201, a test circuit 211 is mounted and a pixel 204 is arranged in matrix, a data signal line (a source bus line) 205 and a scanning line (a gate bus line) 206 are arranged so as to be orthogonal to each other, each scanning line 206 is connected to a gate driver circuit 203, and each data signal line 205 is connected to a source driver circuit 202 (see Patent Document 1). Note that reference numeral 213 denotes an analog switch, 214 denotes a testing line, and 215*a* and 215*b* denote testing terminals.

In the above-described display device, each scanning line 206 controls each pixel. Video signals are sequentially taken into the source driver circuit 202 and all the video signals are outputted simultaneously to each data signal line 205 in accordance with the input of a latch signal, and then inputted to each pixel.

A short circuit between wirings and a broken wiring of the display device can be detected by a method of checking an output by bringing a probe pin into contact with the testing terminal 215*a* provided at the edge of the scanning line 206 or by a method of using the testing circuit 211 at the edge of the data signal line 205 (see Patent Document 1, for instance). In the case of testing the data signal line 205 by using the testing circuit, a testing pulse is inputted to a video signal line 207 and an output waveform from the analog switch 213 is observed in accordance with the output from the testing terminal 215*b*. Defects such as a broken wiring can be easily detected by comparing the testing pulse with the output value.

An object of such a test is to minimize the defects which can be detected only in performing the display operation of a finished panel after assembling a substrate of an image display device. Consequently, the yield of panels is improved and a unit cost thereof can be reduced. Even though a substrate is occupied by an additional area which is not used for displaying an image as a result of forming a test circuit, the unit cost of a panel can be eventually reduced because defects on the panel are detected before assembling.

[Patent Document 1]

Japanese Patent Laid-Open No. 2002-116423

However, the above-mentioned testing method only tests the operations of the source driver circuit 202 and the data signal line 205, and is not sufficient for testing a latch circuit. In the above-mentioned testing method, each data signal line 205 is tested one-by-one by inputting the testing pulse to the video signal line 207 and sequentially driving a switch driver circuit 212. Therefore, if the latch circuit does not operate normally and a preceding signal is left in the data signal line, such a defect can not be detected, thus the testing method is not sufficient.

It is the object of the invention to provide an image display device in which a source driver circuit and a data signal line can be tested with test of a latch circuit. It is a further object of the invention to provide a testing method of the image display device.

SUMMARY OF THE INVENTION

In the invention, a NAND circuit is added to an image display device and connected in series. Accordingly, defects of a data signal line such as a broken wiring will be tested simply and accurately as well as defects of a latch circuit, and even the location of defects will be detected if any.

An image display device according to the invention comprises a plurality of pixels which are arranged in matrix a data signal line and a scanning line which are arranged between the plurality of pixels in longitudinal and lateral directions and connected to the plurality of pixels, and driver circuits which control respectively the data signal line and the scanning line, and the image display device is characterized in that the driver circuits and the pixels are connected to a testing circuit through the data signal line, the testing circuit includes a plurality of NAND circuits connected in series, each of the data signal lines is connected to any one of input portions of the plurality of NAND circuits, and an input portion of the head of the NAND circuits connected in series is connected to a power source voltage and an output portion of the tail of the NAND circuits connected in series is connected to a testing terminal.

A testing method of an image display device according to the invention comprises a plurality of pixels which are arranged in matrix, a data signal line and a scanning line which are arranged between the plurality of pixels in longitudinal and lateral directions and connected to the plurality of pixels, and driver circuits which control respectively the data signal line and the scanning line, and the testing method of the image display device is characterized in that the driver circuits and the pixels are connected to a testing circuit including a plurality of NAND circuits connected in series through the data signal line, each of the data signal lines is connected to respective input portions of the plurality of NAND circuits, an output portion of the testing circuit is connected to a testing terminal, an input portion of the testing circuit is connected to a power source voltage, a testing pulse is inputted to the testing circuit and a square wave signal is supplied to the output of the testing terminal in accordance with the input of the testing pulse.

A testing method of an image display device according to the invention is characterized in that the testing pulse is outputted to the data signal line in accordance with the input of a video signal.

A testing method of an image display device according to the invention is characterized in that the testing pulse is a High signal in all the data signal lines and is switched sequentially to a Low signal.

A testing method of an image display device according to the invention is characterized in that all the testing pulses are inputted simultaneously to the NAND circuits connected in series.

According to the above-described configuration, when the data signal line has a defect, for example when the data signal line does not operate based on the output from a latch circuit due to a broken wiring or a short circuit, a certain output level is maintained until switching the data signal line from High to Low is conducted past the defective point. On the other hand, when the latch circuit has a defect, a certain output level is not changed in switching the data signal line from High to Low at a defective point. Accordingly, the location of the defective point can be detected with pinpoint accuracy by observing the testing output.

According to an image display device and a testing method of the image display device of the invention, NAND circuits are added and connected in series. Therefore, defects of the data signal line such as a broken wiring and operations of a latch circuit are tested simply and accurately, and even the location of defects will be detected if any.

BRIEF DESCRIPTION OF THE DRAWINGS

FIGS. 5A and 5B are diagrams showing a potential level of a testing circuit.

DESCRIPTION OF THE PREFERRED EMBODIMENTS

The invention will be hereinafter explained in details with reference to an embodiment mode.

Figure 1A:
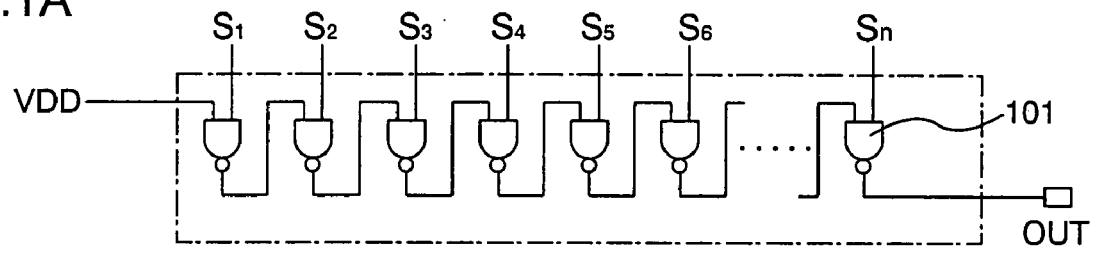
FIGS. 1A and 1B are diagrams showing an embodiment mode of the invention.

FIG. 1A is a testing circuit according to an embodiment mode of the invention. The testing circuit is structured by a NAND circuit 101 having two input portions connected in series. An input portion of the NAND circuit is connected to a data signal line S1, S2, . . . , Sn, one-by-one. A NAND circuit to which a power source voltage VDD is inputted is referred to as the head, another NAND circuit whose output portion is connected to a testing terminal is referred to as the tail for convenience.

Figure 1B:
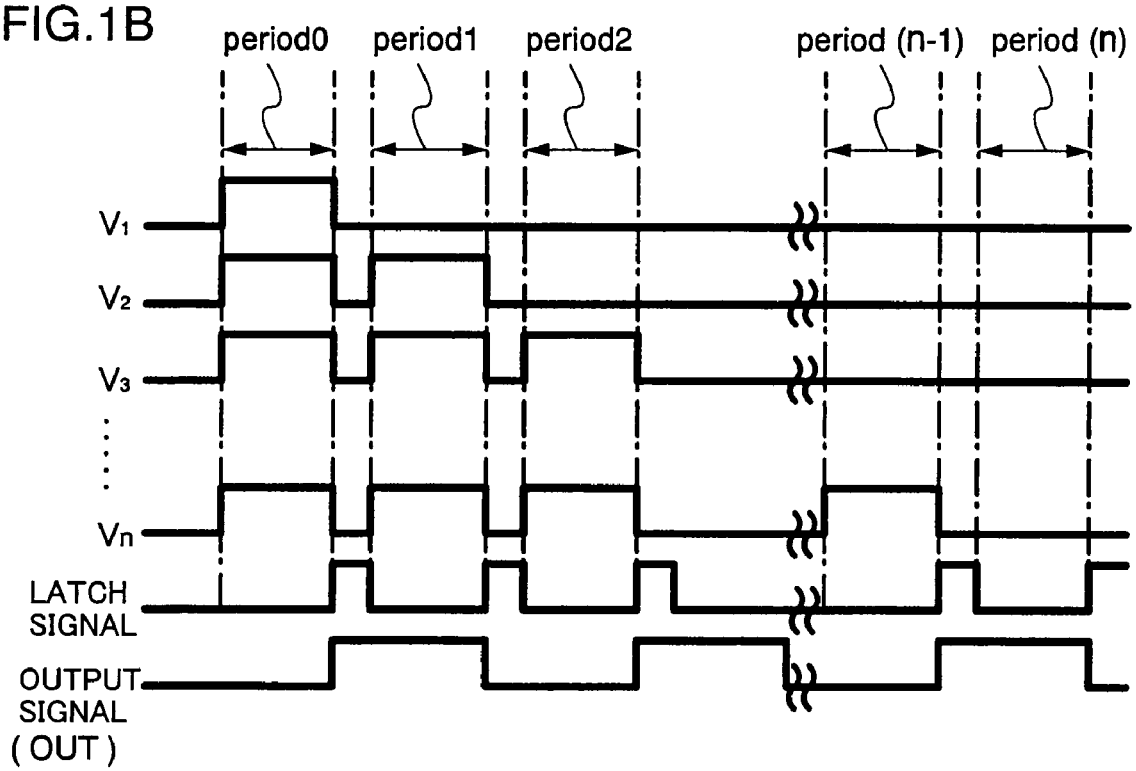
Figure 2:
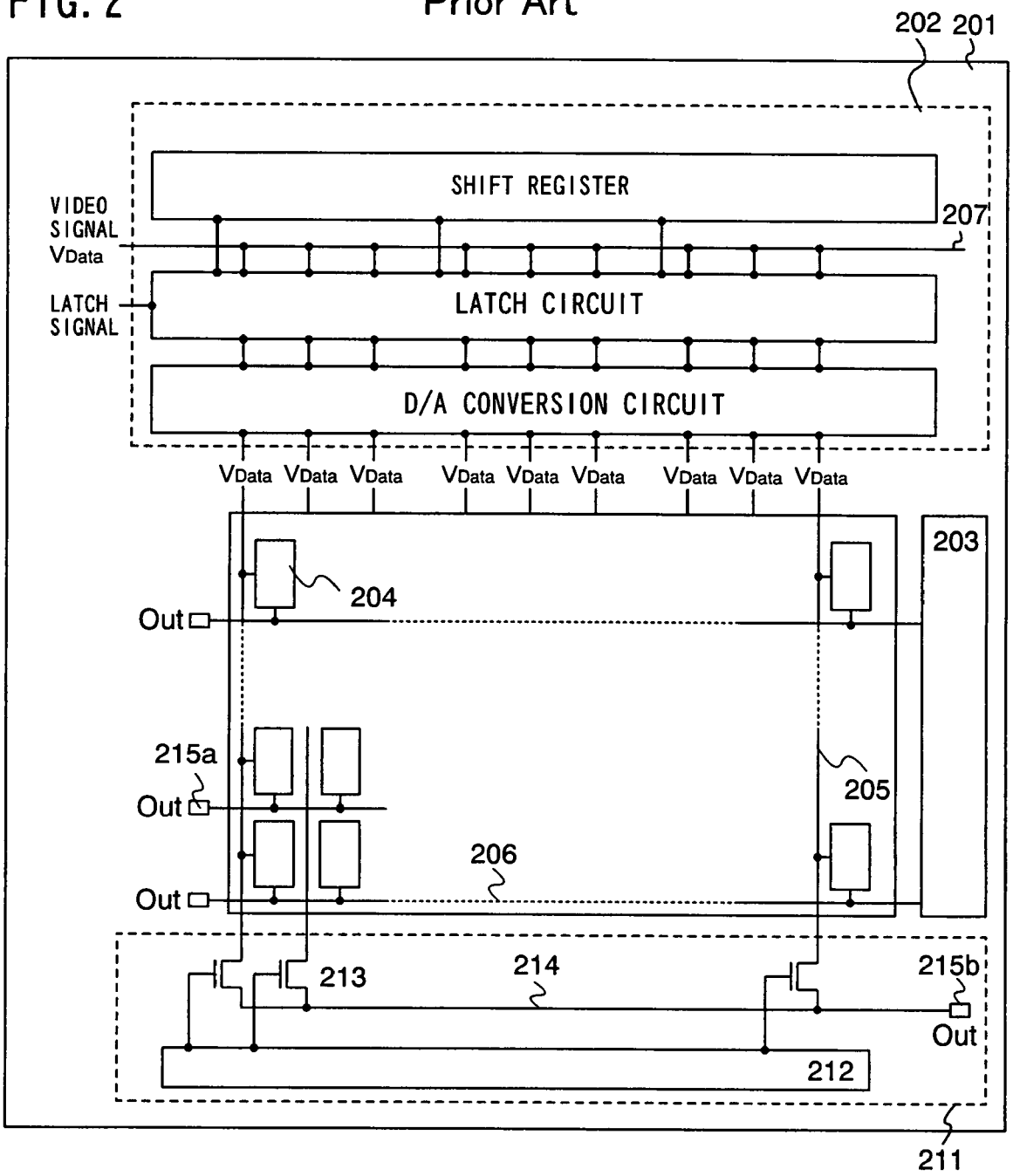
FIG. 2 Prior Art
FIG. 2 is a configuration example of a conventional image display device and a testing method thereof.

Explanation is made on a testing method. The testing circuit as shown in FIG. 1A is formed on a substrate. Each of the data signal lines S1, S2, . . . , Sn is connected to a pixel portion one-by-one. A potential of a testing pulse is outputted to each data signal line and an output signal OUT is observed to conduct a test. FIG. 1B is a timing chart of testing pulses V1, V2, . . . , Vn, a latch signal, and an output signal OUT. The testing pulses V1, V2, . . . , Vn are outputted to the data signal line simultaneously with the input of the latch signal, therefore, the output signal OUT is inverted when the latch signal is inputted.

In present testing method, a High signal is inputted as to all the testing pulses V1, V2, . . . , Vn in an initial state of the test (period 0). In inputting a first latch signal the output signal OUT is Low when the number of data signal lines is odd, and High when the number of data signal lines is even. During the next period (a first state, period 1), a Low signal is inputted only to the testing pulse V1 inputted to the head NAND circuit. During the following periods (period 1 . . . period (n)), the testing pulses are changed from High to Low sequentially toward the tail NAND circuit with every input of the latch signal. Finally, the latch signal is inputted n+1 times in all. In such a manner, the output signal OUT is switched between High and Low with every input of the latch signal as shown in FIG. 1D. If the output signal OUT is not inverted when a latch signal is inputted, a defect can be detected in a latch circuit including a data signal corresponding to the pulse changed to Low.

Figures 4A, 4B:
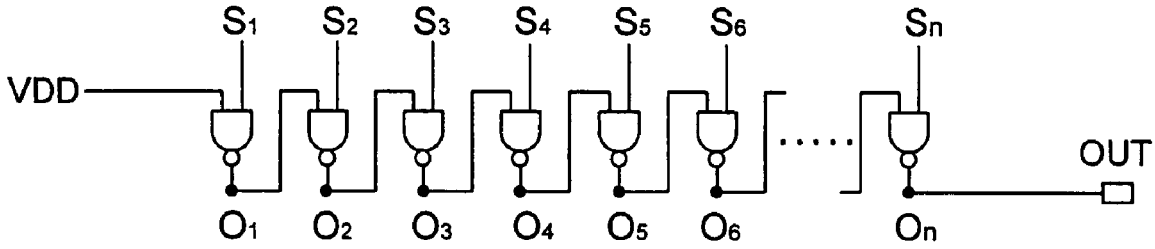
FIGS. 4A and 4B are diagrams showing a potential level of a testing circuit.

A method of detecting a defect is explained in detail with reference to FIGS. 4A and 4B. The testing pulses V1, V2, . . . , Vn are inputted to respective input portions of the testing circuit at the timing of the latch signal through respective data signal lines S1, S2, . . . , Sn as shown in FIG. 4A. Each output of the NAND circuits in the testing circuit is O1, O2, . . . , On, and the output of the tail NAND circuit On corresponds to the output signal OUT. The state of these signals is shown in FIG. 4B (1 and 0 denote a High signal and a Low signal, respectively).

States 401 to 406 in FIG. 4B show potential levels in a normal state after the input of the latch signal. A High signal is inputted to all the testing pulses V1, V2, . . . , Vn, and n is an odd number, therefore, a testing output On is Low in state 401, for example.

States 501 to 506 in FIG. 5A show potential levels in the case of a broken wiring in a fourth data signal line (only Low level). In an initial state of the test 501, a defect is located in an even-numbered data signal line, therefore, the potential level in the testing output On is the same as that in the normal state 401 in FIG. 4B. However, as the potential level in the testing output On is not changed in a first state 502 and a second state 503, a defect can be detected. The change of the potential level in the testing output On can be observed from a fifth state 506, and by observing this change, the location of broken wiring can be detected.

States 507 to 512 in FIG. 5B show potential levels in the case where the fourth data signal line is short circuited to a power source voltage (only High level). In a fourth state 511, since a defect is located in an even-numbered data signal line, the potential level in the testing output On is different from that in the normal state of FIG. 4B. As the change of the potential level can be observed from a sixth state 513, the location of broken wiring can be detected by observing this change of the potential level.

The above-mentioned testing circuit is characterized in that all the data signal lines are inputted simultaneously. Therefore, the change from High to Low is not occurred when the preceding data is left in the latch circuit due to a defect, and the potential level in the testing output On is not changed, thus the location of the defect can be detected.

EMBODIMENT 1

Explanation will be hereinafter made on an embodiment of the invention.

Figure 3A:
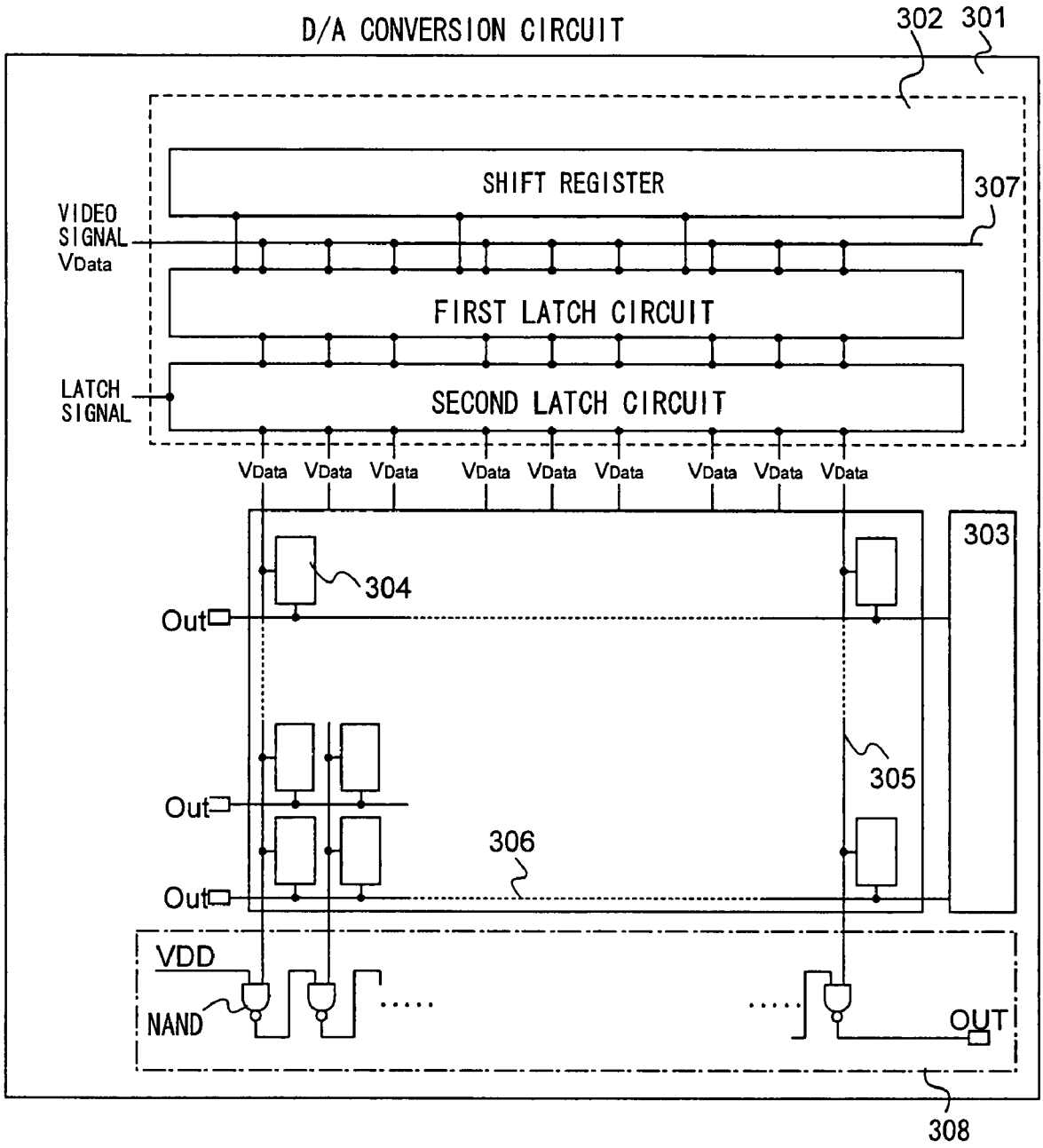
FIGS. 3A and 3B are diagrams showing an embodiment of the invention.

FIG. 3A shows an embodiment of the invention. An image display device includes a substrate 301, a source driver circuit 302, a gate driver circuit 303, a pixel 304, a data signal line 305, a scanning line 306, a video signal line 307, and a testing circuit 308. These circuits may be formed with thin film transistors. The thin film transistors may be manufactured by the methods disclosed in U.S. Patent Application publication No. 2001/0035526 filed by Yamazaki et al. on Apr. 24, 2001 although not limited thereto. The entire disclosure of the U.S. Patent Application publication No. 2001/0035526 is incorporated herein by reference. The testing circuit 308 is placed opposite to the source driver circuit 302, each data signal line 305 is connected to respective input potions of NAND circuits with two input portions, and each NAND circuit is connected in series. A power source voltage VDD is inputted to the head NAND circuit and an output portion of the tail NAND circuit is connected to a testing terminal. In the present invention of this embodiment, video signals are sequentially taken into a first latch circuit and then, inputted to a second latch circuit. After all the video signals are taken into the second latch circuit, they are inputted to the data signal line 305 in accordance with a latch signal. Accordingly, the data signal line is tested by inputting testing pulses V1, V2, . . . , Vn and the latch signal and observing the output signal OUT.

The testing pulses are inputted to each video signal line 307, and a High signal is inputted to all the data signal lines 305 in an initial state of the test. The output signal is changed depending on the number of data signal lines: a Low signal is outputted when the number is odd and a High signal is outputted when the number is even. The testing pulses are inputted to the testing circuit simultaneously with the input of the latch signal, therefore, the testing pulses are changed from High to Low toward the tail NAND circuit with each input of the latch signal to conduct the test. A square wave signal is outputted at this time.

Defects such as a broken wiring and a short circuit can be detected when the output signal OUT is maintained High (or Low) after inverting from the initial state and a square wave signal is observed in the state after the defective point. Switching of the square wave signal between High and Low is conducted simultaneously with the input of the latch signal.

Figure 3B:
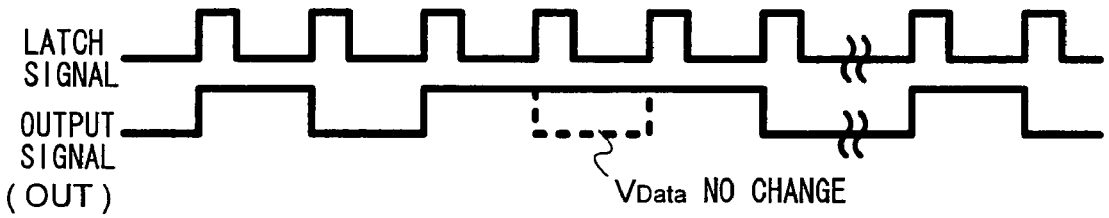

FIG. 3B shows an output signal OUT in the case of detecting a defect in a latch circuit. In FIG. 3B, a High signal is outputted with the input of a first latch signal (an initial state of the test), therefore, the number of data signal lines is confirmed as even (if the number is odd, it means there is a defect). The output signal OUT is inverted in inputting the next latch signal, it is found that there is no defect such as a broken wiring and a short circuit.

In FIG. 3B, however, the output signal OUT is not changed to Low in a third state and normal square wave signals reappear from a fourth state. In such a case, it can be confirmed that there is a defect in the latch circuit. Normally, the signal changed from High to Low has to be inputted to the third data signal line in the third state, but the signal is not completely changed to Low in this case, therefore, a Low signal is not supplied to the output signal OUT. Seeing that a normal output signal OUT is detected from a fourth state, it is confirmed that a latch circuit connected to the third data signal line operates normally in the fourth state (as a Low signal is inputted to the third data signal line in the fourth state, the signal is completely changed to Low in a second input).

When taking in (writing in) a data inputted from a video signal line, the data needs to be maintained before the timing of taking in the data (setup time), and the data needs to be maintained for a certain amount of time after the timing of taking in the data (hold time). In the case of increasing the driving frequency of the shift register, the time for taking in the data needs to be shortened. Whether a data is taken in accurately or not can be tested by using the testing circuit of the invention.

EMBODIMENT 2

In this embodiment, examples of electronic devices mounting the semiconductor device which is applied to the testing circuit of the present invention are described with reference to FIGS. 6A to 6E.

Figure 6A:
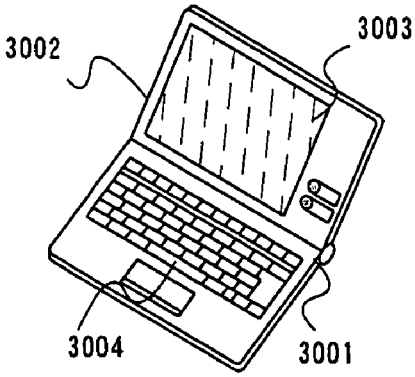
FIGS. 6A to 6E show electronic devices to which a semiconductor device of the present invention is applied.

FIG. 6A is a laptop personal computer manufactured according to the present invention. The laptop personal computer includes a main body 3001, a casing 3002, a display portion 3003, a keyboard 3004, and the like.

Figure 6D:
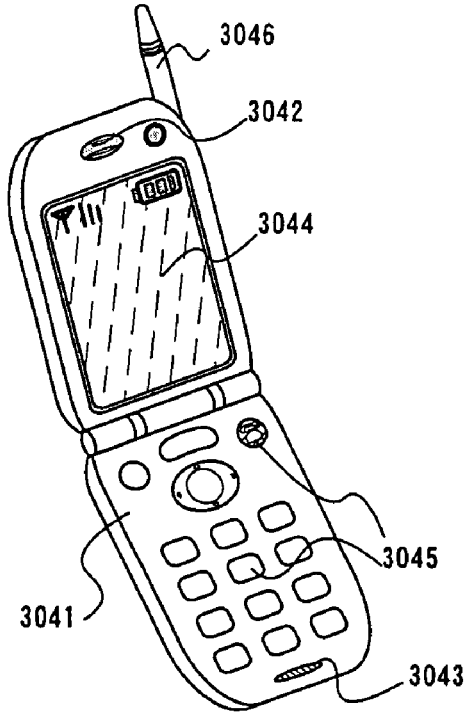
Figure 6B:
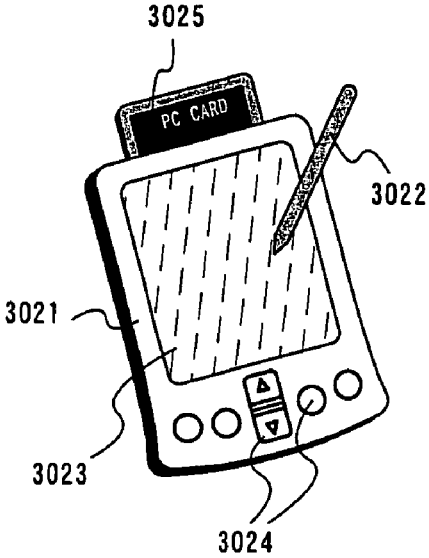

FIG. 6B is a portable information terminal (PDA) manufactured according to the present invention. The portable information terminal includes a main body 3021, a display portion 3023, an external interface 3025, operation keys 3024, and the like. As an attachment for operation, a stylus pen 3022 can be used.

Figure 6E:
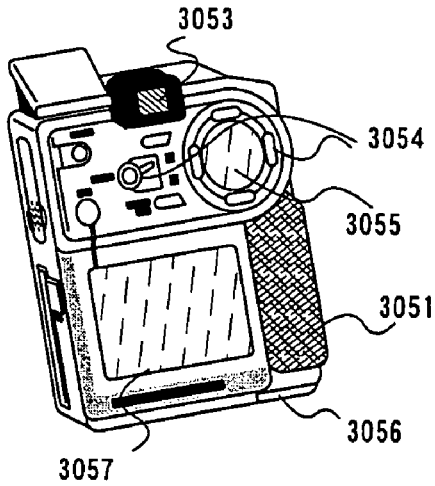
Figure 6C:
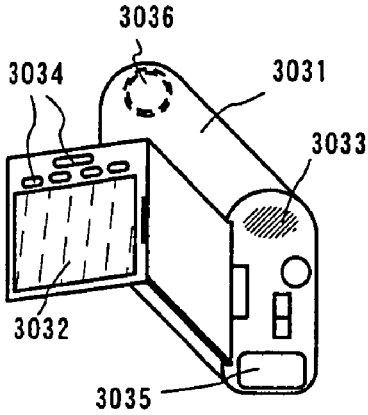

FIG. 6C is a video camera manufactured according to the present invention. The video camera includes a main body 3031, a display portion 3032, an audio input section 3033, operation keys 3034, a battery 3035, an image receiving section 3036, and the like.

FIG. 6D is a cellular phone manufactured according to the present invention. The cellular phone includes a main body 3041, a display portion 3044, an audio output section 3042, an audio input section 3043, operation keys 3045, an antenna 3046, and the like.

FIG. 6E is a digital camera manufactured according to the present invention. The digital camera includes a main body 3051, a display portion A 3057, an eye piece portion 3053, operation keys 3054, a display portion B 3055, a battery 3056, and the like.

What is claimed is:

1. A display device comprising:

a pixel portion including at least two data signal lines;

a driver circuit operationally connected to the pixel portion so as to supply signals to the data signal lines, the driver circuit including a latch circuit;

a test circuit operationally connected to the pixel portion, the test circuit including:

a plurality of two input NAND circuits connected in series wherein a first input of one of the plurality of two input NAND circuits is directly connected to an output of another one of the plurality of two input NAND circuits, wherein each of a second input of the plurality of two input NAND circuits is connected to one of the data signal lines, wherein the data signal lines are connected to the latch circuit, and wherein the data signal lines are connected to a plurality of pixels.

2. The display device according to claim 1, wherein a first input of the first of the plurality of two input NAND circuits connected in series is connected to a power source.

3. The display device according to claim 1, wherein an output of the last of the plurality of two input NAND circuits connected in series is connected to a testing terminal.

4. A testing method of a display device including:

a pixel portion including at least two data signal lines;

a driver circuit operationally connected to the pixel portion so as to supply signals to the data signal lines, the driver circuit including a latch circuit;

a test circuit operationally connected to the pixel portion, the test circuit including:

a plurality of two input NAND circuits connected in series, wherein a first input of one of the plurality of two input NAND circuits is directly connected to an output of another one of the plurality of two input NAND circuits, wherein each of a second input of the plurality of two input NAND circuits is connected to one of the data signal lines, and wherein the data signal lines are connected to a plurality of pixels, the testing method comprising:

adding a voltage to a first input of the first of the plurality of two input NAND circuits connected in series;

inputting a testing pulse to the data signal lines; and comparing a wave form of the testing pulse and a wave form of an output of the last of the plurality of two input NAND circuits connected in series.

5. The testing method according to claim 4, wherein the testing pulse is a High signal in all the data signal lines and is switched sequentially into a Low signal.

6. The testing method according to claim 4, wherein the testing pulse is a pulse output to the data signal lines in accordance with an input of a video signal.

7. A display device comprising:

a pixel portion including at least two data signal lines;

a driver circuit operationally connected to the pixel portion so as to supply signals to the data signal lines, the driver circuit including a latch circuit;

a test circuit operationally connected to the pixel portion, the test circuit including:

a plurality of two input NAND circuits connected in series wherein a first input of one of the plurality of two input NAND circuits is connected to an output of another one of the plurality of two input NAND circuits, wherein each of a second input of the plurality of two input NAND circuits is directly connected to one of the data signal lines, wherein the data signal lines are connected to the latch circuit, and wherein the data signal lines are connected to a plurality of pixels.

8. The display device according to claim 7, wherein a first input of the first of the plurality of two input NAND circuits connected in series is connected to a power source.

9. The display device according to claim 7, wherein an output of the last of the plurality of two input NAND circuits connected in series is connected to a testing terminal.

10. The display device according to claim 7, wherein the first input of one of the plurality of two input NAND circuits is directly connected to the output of another one of the plurality of two input NAND circuits.

* * * * *